US010317161B2

(12) United States Patent
Arnedo Vera et al.

(10) Patent No.: US 10,317,161 B2
(45) Date of Patent: Jun. 11, 2019

(54) SPORTING RIFLE WITH SOUND SUPPRESSOR

(71) Applicant: GAMO OUTDOOR, S.L., Barcelona (ES)

(72) Inventors: Julian Arnedo Vera, Barcelona (ES); Victor Tresserras Torre, Barcelona (ES)

(73) Assignee: Gamo Outdoor, S.L., Barcelona (ES)

( * ) Notice: Subject to any disclaimer, the term of this patent is extended or adjusted under 35 U.S.C. 154(b) by 0 days.

(21) Appl. No.: 15/763,903

(22) PCT Filed: Sep. 29, 2016

(86) PCT No.: PCT/ES2016/070688

§ 371 (c)(1),
(2) Date: Mar. 28, 2018

(87) PCT Pub. No.: WO2017/055668

PCT Pub. Date: Apr. 6, 2017

(65) Prior Publication Data

US 2018/0274874 A1 Sep. 27, 2018

(30) Foreign Application Priority Data

Oct. 1, 2015 (ES) ..... 201531407

(51) Int. Cl.
*F41A 21/30* (2006.01)
*F41A 21/02* (2006.01)

(52) U.S. Cl.
CPC ..... *F41A 21/30* (2013.01); *F41A 21/02* (2013.01)

(58) Field of Classification Search
CPC ..... F41A 21/30; F41A 21/02; F41A 21/28; F41A 21/32; F41A 21/325; F41A 21/34
(Continued)

(56) References Cited

U.S. PATENT DOCUMENTS 1,111,202 A * 9/1914 Westfall ..... F41A 21/30 181/223
3,399,597 A * 9/1968 Perrine ..... F41A 21/30 181/223

(Continued)

FOREIGN PATENT DOCUMENTS

EP 2112452 4/2010
EP 2345012 10/2013

(Continued)

OTHER PUBLICATIONS

PCT International Search Report, International Application No. PCT/ES2016/070688, dated Dec. 13, 2016, pp. 1-3.

*Primary Examiner* — John Cooper
(74) *Attorney, Agent, or Firm* — Hunton Andrews Kurth LLP

(57) ABSTRACT

Comprises at least, a stock, a trigger mechanism and a barrel (1) partially covered over by over-moulded or over-injected material (2), defining therefore by said over-moulded or over-injected material (2) a first area or housing (3) for the mounting of a sound suppressor (4) following up or alongside the barrel (1) and a second area (8) at least wrapping around the part of the barrel (1), and that the sound suppressor (4) comprises:

an inlet (5) wherein the barrel (1) is situated, comprising a support (7) of diameter equal to second area (8) on which it is fitted, with perforations (18) that connect said second area 8 with first area or housing (3) and an outlet (6) that comprises an attached stop (9).

6 Claims, 4 Drawing Sheets

(58) Field of Classification Search
USPC ..... 89/14.4, 14.3; 181/223; 125/85
See application file for complete search history.

(56) References Cited

U.S. PATENT DOCUMENTS

| | | | | |
|---|---|---|---|---|
| 5,355,765 | A * | 10/1994 | Rogers | F41A 13/12 89/14.4 |
| 6,374,718 | B1 * | 4/2002 | Rescigno | F41A 21/30 89/14.4 |
| 7,789,008 | B2 * | 9/2010 | Petersen | F41A 21/30 89/14.4 |
| 8,162,100 | B2 * | 4/2012 | Shults | F41A 21/30 181/223 |
| 8,881,862 | B1 * | 11/2014 | Messer, Jr. | F41A 21/30 181/223 |
| 9,658,018 | B1 * | 5/2017 | Heckert | F41A 21/30 |
| 9,879,933 | B2 * | 1/2018 | Myers | F41A 21/30 |
| 2010/0058922 | A1 * | 3/2010 | Casas Salva | F41A 21/02 89/14.4 |
| 2012/0110885 | A1 | 5/2012 | Pelin | |
| 2012/0279798 | A1 | 11/2012 | Kline et al. | |
| 2014/0007481 | A1 * | 1/2014 | Tresserras Torre | F41A 21/02 42/76.1 |
| 2015/0090105 | A1 * | 4/2015 | Pace | F41A 21/30 89/14.4 |
| 2017/0336165 | A1 * | 11/2017 | Wirth | F41A 21/30 |

FOREIGN PATENT DOCUMENTS

| | | |
|---|---|---|
| EP | 2677267 | 12/2013 |
| WO | WO 2013/104811 | 7/2013 |

* cited by examiner

SPORTING RIFLE WITH SOUND SUPPRESSOR

A sporting rifle with sound suppressor, of the type that comprises at least a stock, a trigger mechanism and a barrel partially covered over by an over-moulded or over-injected material, defining therefore by said over-moulded or over-injected material a first area or housing for the mounting of a sound suppressor following up or alongside the barrel and a second area wrapping at least part of the barrel, characterised in that the sound suppressor comprises: an inlet in which the barrel is situated comprising a support of a diameter equal to the second area on which it is fitted, with perforations that connect said second area with the first area or housing and an outlet that comprises an attached stop.

BACKGROUND TO THE INVENTION

In the state of the art, various rifles are known, in which the barrel and the silencer or suppressor are, in turn, covered exteriorly by an over-moulding.

In fact, all these patents belong to the applicant's firm.

Thus, European Patent 2112452 (ES2345012) "FIREARM OR SPORTS GUN WITH SILENCER" filed in 2008 is known, it refers to a rifle that comprises a trigger mechanism, an over-moulded or over-injected barrel, a chamber, which is characterised in that it comprises an over-moulded or over-injected sound suppressor on the mentioned barrel.

Also it is known European Patent 2677267 (ES2531858) "METHOD FOR MANUFACTURING A BULL BARREL EQUIPPED WITH SILENCER AND SILENCER EQUIPPED BULL BARREL THUS OBTAINED", filed in 2011, which refers to a procedure for manufacturing a barrel model "bull barrel" with sound suppressor and barrel "bull barrel" with obtained sound suppressor that comprises: the following steps: a first step in which a tube that defined two ends, a first and second, with an inner diameter greater than the barrel outside diameter, fixed to a wedge by its first end, a second step in which a muzzle that ends in a hood is fixed to the second end of the tube, with said muzzle comprising at least one lateral aperture and at least one first hoop that fits into the tube sealing the second tube end with stops that define channels in the hood, which connect the outside with the muzzle interior, being the mentioned stops at the end of the referred tube travel, a third step in which the barrel is fixed to the muzzle and the wedge, defining a space or cavity between the tube and the barrel and a fourth step in which the configuration of the third step is inserted into a moulding machine that over-moulds it, with the exception of the barrel entrance end, giving it the desired form, with said over-moulding penetrating into the tube by the channels up to the referred first hoop.

Finally, it should be mentioned the PCT Application WO2013104811 "METHOD OF MANUFACTURING OF A BARREL FOR COMPRESSED AIR OR CO2 RIFLES AND BARREL OBTAINED BY SAID METHOD", filed in 2012, which refers to a procedure for the manufacture of a barrel for compressed air of CO2 rifles, which comprises a hollow tube, through the interior of which circulates a pellet, with an inlet end and an outlet end, characterized in that it comprises: a first step in which the tube is inserted into a moulding machine and fixing elements or supports are introduced, fixing the tube and leaving it overhanging, centred, stable, inside the moulding machine and a second step in which the tube is over-moulded, with the exception of the tube inlet end, giving it the desired form.

BRIEF DISCLOSURE OF THE INVENTION

Since some years ago the actual applicant's firm has been patenting and marketing rifles with barrels and over-moulded silencers or sound suppressors that are exteriorly formed a single part.

This invention affects the sound suppressor system or silencer.

Thus, the inventors have applied the procedure of the manufacture disclosed in EP2345012, seeking a product similar to that one obtained in EP2677267, but without employing the internal profile and thus, saving the costs of this profile and lighten the rifle.

Obviously this is a rifle that does not fulfil the same function as the two previously mentioned ones, which are intended for another type of sportsman.

Thus, it is achieved a forward suppressor on the one hand, and a backward sound suppressor on the other, but being between the barrel's and the over-moulding walls.

Furthermore, being the cover manufactured with the actual sound suppressor together in one of its preferred embodiments, its installation is easier and more reliable.

One objective of this invention is a sporting rifle with sound suppressor, of the type that comprises at least a stock, a trigger mechanism and a barrel partially covered over by an over-moulded or over-injected material, defining therefore by said over-moulded or over-injected material a first area or housing for the mounting of a sound suppressor following up or alongside the barrel and a second area wrapping at least part of the barrel, characterised in that the sound suppressor comprises: an inlet in which the barrel is situated comprising a support of a diameter equal to the second area on which it is fitted, with perforations that connect said second area with the first area or housing and an outlet that comprises an attached stop.

BRIEF DESCRIPTION OF THE DRAWINGS

In order to facilitate the description, this description is accompanied by four sheets of drawings that represent a practical embodiment, which is cited as a non-limiting example of the scope of this invention.

SPECIFIC EXEMPLARY EMBODIMENT OF THIS INVENTION

Firstly, it is understood that when employing the term "over-moulding", it also covers the "over-injected" option and is used to facilitate the reading and clarity of the description.

Figure 1:
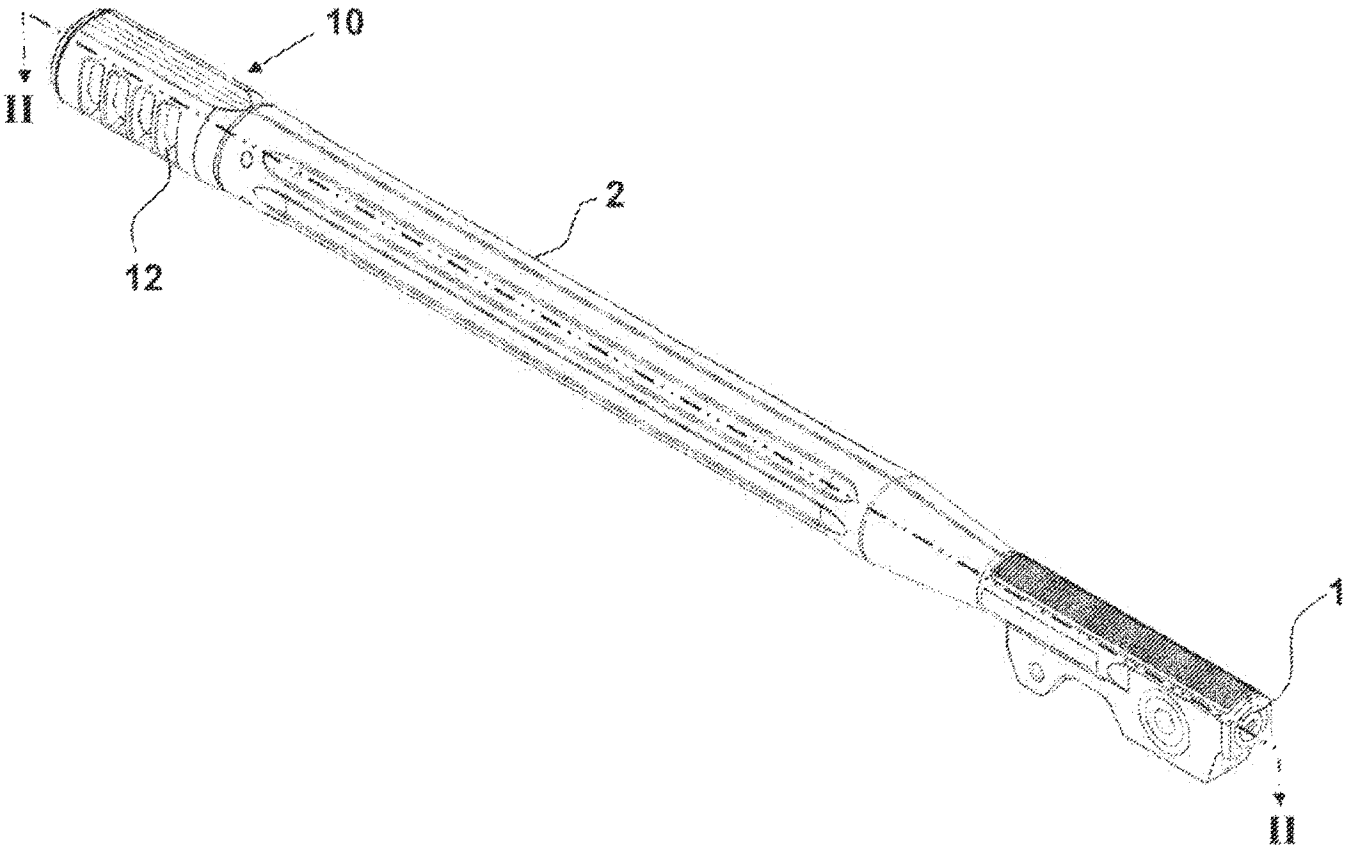
FIG. 1 is a perspective view of the barrel.

Thus, FIG. 1 shows a barrel 1, an over-moulded material 2, a muzzle 10 and gas outlets 12 provided in the over-moulding 2.

Figure 2:
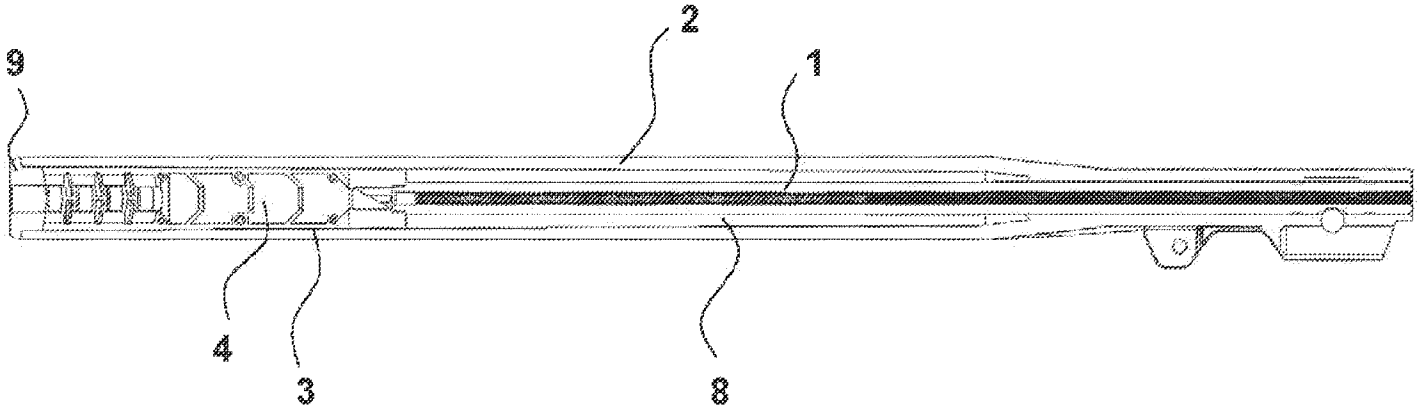
FIG. 2 is a cross-section view along line II-II of FIG. 1.

FIG. 2 illustrates the barrel 1, the over-moulded material 2, a first area 3 or housing, a sound suppressor 4 with a stop 9 and a second area 8.

Figure 3:
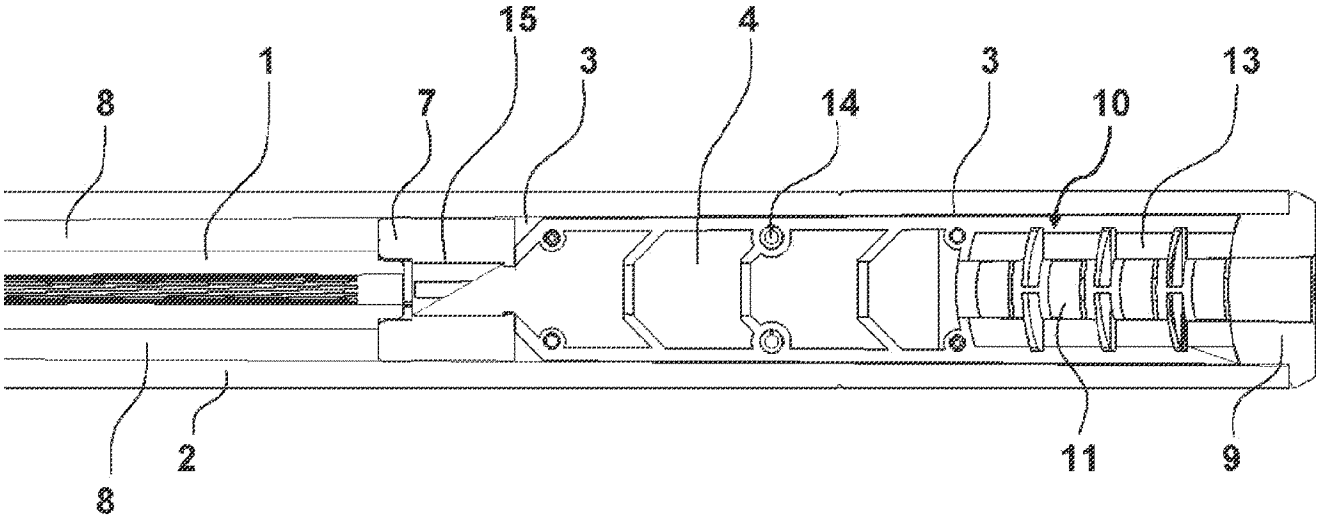
FIG. 3 is a detailed view of FIG. 2, specifically of the sound suppressor.

FIG. 3 represents the barrel 1, the over-moulded material 2, the first area 3, the second area 8, the sound suppressor 4 with a support 7 and support means 15, the stop 9, the muzzle 10, gas outlets 11 of the sound suppressor 4, guides or internal walls 13 and fixing means 14.

Figure 4:
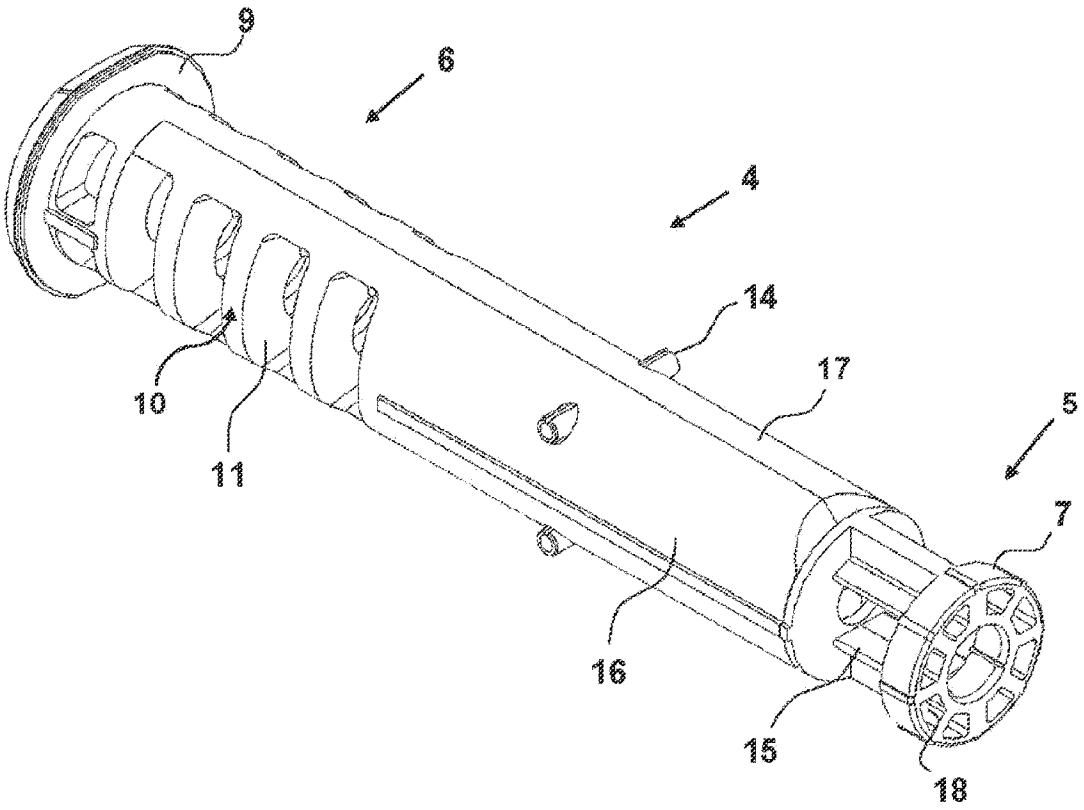
FIG. 4 is a perspective view of the sound suppressor.

Lastly, FIG. 4 is a drawing of the sound suppressor 4 in two parts, 16, 17, with an inlet 6 and an outlet 5, the support 7, with perforations 18, the stop 9, the muzzle 10, gas outlets 11 of the sound suppressor 4, fixing means 14 and support means 15.

Firstly, it is indicated that the over-moulding of this rifle may be accomplished in various ways, merely as examples, the two of them are indicated, the over-moulding barrel 1 and the sound suppressor 4 or the over-moulding barrel 1 and allowing the over-moulding 2 to dry, thereby defining the housing 3 suitable for subsequently inserting the sound suppressor 4 into it.

The sporting rifle with the sound suppressor comprises a stock, a trigger mechanism (not illustrated) and the barrel 1, partially covered by the over-moulded material 2.

The sound suppressor 4 has the first area 3 configured by the over-moulding 2.

The second area 8 is also configured around the part of barrel 1, that wraps around it, between over-moulding 2 and barrel (FIGS. 2 and 3).

The sound suppressor 4 comprises the inlet 5 wherein the barrel 1 is situated and which comprises the support 7 of a diameter equal to the second area 8 on which it is fitted, with the perforations 18 that connect said second area 8 with first area or housing 3.

These perforations 18 perform the function of configuring second area 8 as an additional sound suppressor. When sound reaches the inlet 5 of the sound suppressor, some portion of the sound moves backwards throughout the perforations 18 towards said second area, thus damping the sound, suppressing the sound in general.

The firing will continue forwards and will be reduced by passing through the sound suppressor 4 until its outlet through the stop 9. The stop 9 is attached into the sound suppressor 4, therefore the parts are reduced and it is facilitated that the stop 9 is always built in.

Optionally, the sound suppressor 4 comprises the muzzle 10 with gas outlets 11 (FIGS. 2, 3 and 4), which coincide with gas outlets 12 provided in the over-moulding 2 that covers the sound suppressor 4 (FIG. 1). This enables the gas outlet to be increased and improves the rifle reliability.

Furthermore optionally it is provided that gas outlets 11 on the sound suppressor 4 comprise guides 13 or interior walls. This is done in order to increase barrel resistance. It is often employed the muzzle 10 zone to provide force to articulate barrel 1 in "break barrel" or articulated barrel types, therefore, said guides 13 are arranged to prevent the fractures.

Optionally there are provided fastening means 14 (pins, screws, etc.), which pass through over-moulding 2 and are positioned in the sound suppressor 4 to fix it. This is done in order to prevent movements caused by gas pressure in the recoil outlet.

In order to improve the positioning of the barrel 1 with respect to the sound suppressor 4, there is an option for support means 15 on the actual sound suppressor 4 provided in the inlet 5 after support 7. Therefore, when the sound suppressor 4 is introduced inside the first area 3, said support means 15 will assist in the correct positioning of sound suppressor 4 with respect to the barrel 1.

The sound suppressor 4 may be manufactured in two parts 16, 17, either symmetrical or asymmetrical (as in the example of FIG. 4), facilitating the manufacturing processes of the same, or in a single part as well.

This invention patent describes a new sporting rifle with sound suppressor. The examples mentioned here do not limit this invention and thus, can have various applications and/or adaptations, all of which are within the scope of the following claims.

The invention claimed is:

1. A sporting rifle comprising:

a cylindrical barrel extending distally from a proximal barrel end to a distal barrel end;

an annular barrel molding configured and positioned so as to surround at least a portion of the barrel adjacent the distal barrel end and to extend distally therefrom, the barrel molding having a cylindrical inner surface defining a first interior space distal to the distal barrel end and a second interior space between the cylindrical inner surface and the at least a portion of the barrel adjacent the distal barrel end, the barrel molding being formed from an over-molded or over-injected material;

a sound suppressor positioned within the first interior space, the sound suppressor comprising a cylindrical main body portion having a main body interior passage, an inlet portion proximal to the main body portion, the inlet portion comprising a cylindrical support having an outer diameter equal to a diameter of the cylindrical inner surface of the barrel molding, a center bore sized and configured to receive and support the distal barrel end, and a plurality of perforations surrounding the center bore to connect said second interior area with said first interior area distal to the cylindrical support, a support disc having an outer diameter equal to the diameter of the cylindrical inner surface and a center hole in registration with an entrance to the main body interior passage, the disc support being distally spaced from the cylindrical support, and an outlet portion distal to the main body portion, the outlet portion terminating in an attached stop.

2. A sporting rifle in accordance with claim 1 wherein, the annular barrel molding has a plurality of gas outlets formed therein, and the outlet portion of the sound suppressor has a plurality of suppressor gas outlets corresponding to and in registration with the gas outlets of the annular barrel molding.

3. A sporting rifle in accordance with claim 2 wherein the outlet portion comprises a plurality of interior walls configured to strengthen the sound suppressor.

4. A sporting rifle in accordance with claim 1 further comprising fastening means for fixing the sound suppressor to the annular barrel molding.

5. A sporting rifle in accordance with claim 1 wherein the inlet portion of the sound suppressor comprises at least one horizontal support member connecting the cylindrical support to the support disc.

6. A sporting rifle in accordance with any of the previous claims wherein the sound suppressor is formed from two symmetrical or asymmetrical parts.

* * * * *